US008661713B2

(12) United States Patent
Koo et al.

(10) Patent No.: US 8,661,713 B2
(45) Date of Patent: Mar. 4, 2014

(54) ALTERNATING BONDED PARTICLES AND PROTRUSIONS

(75) Inventors: John Koo, Los Angeles, CA (US); Jonathan Goldberg, Los Angeles, CA (US)

(73) Assignee: Dynasty Footwear, Ltd., El Segundo, CA (US)

( * ) Notice: Subject to any disclaimer, the term of this patent is extended or adjusted under 35 U.S.C. 154(b) by 1884 days.

(21) Appl. No.: 11/530,419

(22) Filed: Sep. 8, 2006

(65) Prior Publication Data

US 2007/0017124 A1 Jan. 25, 2007

Related U.S. Application Data

(63) Continuation-in-part of application No. 10/613,741, filed on Jul. 3, 2003, which is a continuation-in-part of application No. 10/438,375, filed on May 15, 2003, now Pat. No. 7,191,549.

(60) Provisional application No. 60/745,926, filed on Apr. 28, 2006, provisional application No. 60/803,351, filed on May 26, 2006, provisional application No. 60/460,260, filed on Apr. 3, 2003.

(51) Int. Cl.

| | |
|---|---|
| ***A43B 15/00*** | (2006.01) |
| ***A43B 3/18*** | (2006.01) |
| ***A43B 5/08*** | (2006.01) |
| ***A43B 13/02*** | (2006.01) |
| ***A43B 13/12*** | (2006.01) |
| ***A43B 13/22*** | (2006.01) |

(52) U.S. Cl.
CPC ..... *A43B 13/02* (2013.01); *A43B 13/12* (2013.01); *A43B 13/223* (2013.01)
USPC ..... 36/59 C; 36/59 R; 36/8.1; 36/7.6

(58) Field of Classification Search
CPC .... A43B 13/223; A43B 13/26; A43B 13/141; A43B 13/04; A43B 13/02; A43B 13/12; A43C 15/00; A43C 15/12; A43C 15/161
USPC ..... 36/59 C, 59 R, 8.1, 7.7, 7.6, 7.1 R, 113, 36/26, 132, 136; 12/146 BR
See application file for complete search history.

(56) References Cited

U.S. PATENT DOCUMENTS

| | | | |
|---|---|---|---|
| 123,450 | A | 2/1872 | Bryant |
| 140,241 | A | 6/1873 | Bryant |

(Continued)

FOREIGN PATENT DOCUMENTS

| | | |
|---|---|---|
| CN | 98234514.3 | 12/1999 |
| GB | 2 201 082 | 8/1988 |
| JP | S59-362 | 1/1984 |
| JP | H3-170101 | 7/1991 |

*Primary Examiner* — Jila M Mohandesi
(74) *Attorney, Agent, or Firm* — Joseph G. Swan, P.C.

(57) ABSTRACT

Provided is a shoe outsole and/or a sheet material which can be used to fabricate such an outsole (among other things), formed of a base material that includes a number of indentations and lower-extending portions. Small particles are bonded to at least some of the indentations, but the lower-extending portions predominantly are uncoated with such small particles. Also provided are methods and techniques for manufacturing such outsoles and sheet material, as well as shoes incorporating such outsoles.

18 Claims, 4 Drawing Sheets

(56) References Cited

U.S. PATENT DOCUMENTS

| | | | | | |
|---|---|---|---|---|---|
| 1,978,030 | A | * | 10/1934 | Ritchie | 264/153 |
| 1,989,467 | A | * | 1/1935 | Schaffer | 12/142 B |
| 2,287,282 | A | * | 6/1942 | Tousley | 264/130 |
| 2,400,487 | A | * | 5/1946 | Clark | 428/89 |
| 2,663,097 | A | * | 12/1953 | Giese, Jr. | 36/9 R |
| 2,793,136 | A | * | 5/1957 | Root | 428/147 |
| 3,698,357 | A | | 10/1972 | Spencer | |
| 3,776,753 | A | | 12/1973 | Habib | |
| 3,798,048 | A | | 3/1974 | Brody et al. | |
| 3,824,715 | A | | 7/1974 | Vaughan, Jr. et al. | |
| 4,160,331 | A | * | 7/1979 | Bell | 36/59 B |
| 4,356,643 | A | * | 11/1982 | Kester et al. | 36/59 C |
| 4,535,121 | A | | 8/1985 | Oezelli et al. | |
| 4,640,858 | A | | 2/1987 | Barnett | |
| 4,658,514 | A | * | 4/1987 | Shin | 36/30 R |
| 4,779,360 | A | * | 10/1988 | Bible | 36/7.7 |
| 4,879,969 | A | | 11/1989 | Haranoya et al. | |
| 4,899,411 | A | * | 2/1990 | Johnson et al. | 12/142 R |
| 4,963,422 | A | | 10/1990 | Katz et al. | |
| 5,108,777 | A | | 4/1992 | Laird | |
| 5,290,607 | A | | 3/1994 | Chitouras | |
| 6,106,920 | A | | 8/2000 | Pichon et al. | |
| 6,214,141 | B1 | | 4/2001 | Kim et al. | |
| 2004/0163190 | A1 | * | 8/2004 | Loughran | 12/146 B |

* cited by examiner

ALTERNATING BONDED PARTICLES AND PROTRUSIONS

This application claims the benefit of U.S. Provisional Patent Application Ser. No. 60/745,926, filed on Apr. 28, 2006, and titled "Shoe Bottom With Alternating Bonded Fibers And Protrusions" and U.S. Provisional Patent Application Ser. No. 60/803,351, filed on May 26, 2006, and titled "Sheet Material with Embedded Fibers or Fabric Material", and is a continuation-in-part of commonly assigned patent application Ser. No. 10/613,741, filed on Jul. 3, 2003, and titled "Shoe Having a Contoured Bottom with Small Particles Bonded to the Lowest Extending Portions Thereof" (the '741 Application). The '741 Application, in turn, is a continuation-in-part of commonly assigned patent application Ser. No. 10/438,375 filed on May 15, 2003 now U.S. Pat. No. 7,191,549 and titled "Particulate-Bottomed Outdoor Shoe" (the '375 Application) and claims the benefit of U.S. Provisional Patent Application Ser. No. 60/460,260 titled "Flock-Bottomed Outdoor Shoe" filed on Apr. 3, 2003. Each of the foregoing applications is incorporated by reference herein as though set forth herein in full.

FIELD OF THE INVENTION

The present invention pertains to materials having a surface area that includes alternating protrusions and bonded particles and is particularly applicable to the use of such materials for a shoe's outsole.

BACKGROUND

A variety of different types of shoes exist. However, improvements in the construction and characteristics of shoes still are desirable, particularly with respect to the design of a shoe's outsole.

Certain approaches to the design and construction of shoes and, in particular, of a shoe's outsole are described in the above-referenced priority applications and in commonly assigned patent application Ser. No. 10/630,032 filed on Jul. 30, 2003, and titled "Shoe Bottom Having Interspersed Materials", which application is incorporated by reference herein as though set forth herein in full. Additional improvements are described and claimed in this application.

SUMMARY OF THE INVENTION

The present invention provides a shoe outsole and/or a sheet material which can be used to fabricate such an outsole (among other things), formed of a base material that includes a number of indentations and lower-extending portions. Small particles are bonded to at least some of the indentations, but the lower-extending portions predominantly are uncoated with such small particles. Also provided are methods and techniques for manufacturing such outsoles and sheet material, as well as shoes incorporating such outsoles.

The foregoing summary is intended merely to provide a brief description of the general nature of the invention. A more complete understanding of the invention can be obtained by referring to the claims and the following detailed description of the preferred embodiments in connection with the accompanying figures.

DESCRIPTION OF THE PREFERRED EMBODIMENT(S)

Figure 1:
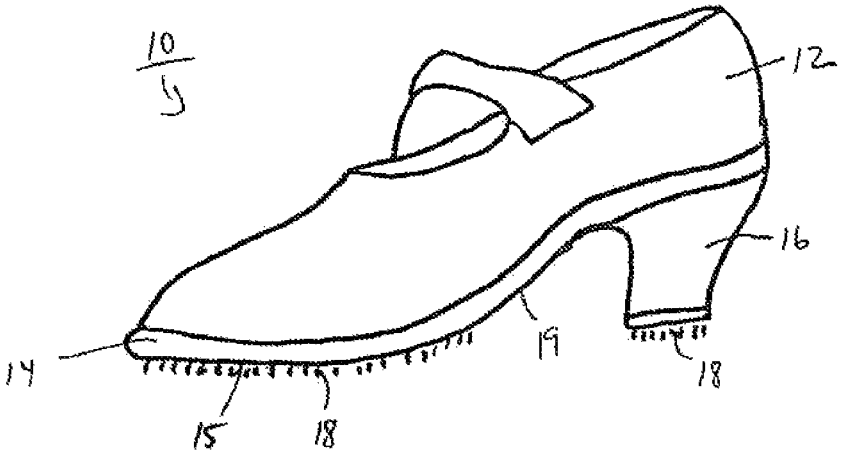
FIG. 1 illustrates a perspective view of a shoe according to a representative embodiment of the present invention.

Generally speaking, the present invention concerns a shoe having small particles bonded to its bottom surface. Such particles may be any of a variety of shapes, such as being thin fibers, cylindrical, ellipsoid, cubical, cuboid, other polyhedron or substantially spherical, with the chosen shape typically depending upon the type of material being utilized and the effect that is desired to be achieved. The most important aspect of such particles is their small size, and typically they will weigh less than 0.1, 0.01, 0.001, 0.0001, 0.00001 or even 0.000001 gram each, on average. In any event, it is preferable that such particles are small enough to permit a large number of distinct particles to be attached to the bottom surface of the shoe. Depending upon the amount of surface area to be covered and the size of the particle used, typically at least 100, 1,000, 10,000, 100,000 or 1,000,000 such particles will be used.

Generally speaking, such particles may be formed from any type of material. Examples include any of: wood (e.g., ground into dust or converted into pulp and then formed into small particles); paper (e.g., converted into pulp and then formed into small particles); leather (e.g., dried and ground into small particles); a composite leather and wood mixture; glass; natural or synthetic fibers; natural plant material (e.g., dried and ground into small particles or else cut or separated into small, thin fibers), natural or synthetic rubber, any of a variety of different types of metal (e.g., steel or aluminum), plastic, silicone, Styrofoam, or any other type of material, although natural and/or organic materials generally are preferred. In each case, the material preferably is ground, cut, broken or formed into small particles of a size appropriate for the intended purpose, e.g., any of the sizes listed above.

Generally speaking, the foregoing particles will adhere to the bottom surface of a shoe using a separate glue or other separate adhesive material. Various types of adhesive can be used depending upon the desired wearability, durability and density of the particles.

In the preferred application process, adhesive material is applied (preferably, a liquid adhesive applied in a uniform manner) to the bottom surface of the shoe (i.e., that portion which is adjacent to the ground). Then, the particles are applied onto the bottom surface of the shoe using any of a variety of different techniques. For example, the particles may be (i) sprayed (e.g., using a compressed air spray) onto the bottom surface of the shoe; (ii) made airborne (e.g., by blowing the particles into the air or dropping them from an appropriate height) and then allowed to settle on the bottom surface of the shoe; (iii) pressed onto the bottom surface of the shoe; (iv) rolled onto the bottom surface of the shoe; or (v) in a more specialized technique that generally will only be suitable for certain types of particles, flocked onto the bottom surface of the shoe. In any event, the particles preferably are applied in a controlled and/or predetermined manner in order to produce a uniform appearance of the particles on the bottom surface of the shoe. A certain amount of randomness may be part of such particle-application process, such as is present in flocking, spraying and allowing the particles to drift downwardly and settle; however, the process nevertheless preferably is controlled so is to produce a distribution having a uniform density (or at least a density having controlled variations).

In a somewhat modified technique, the particles are suspended in a solution which is then brushed on (or otherwise applied) and allowed to dry. Such a technique is similar to the way that felts and similar nonwoven fabrics sometimes are manufactured.

The particles may be bonded directly to the bottom surface of the shoe or else may be first bonded to a separate substrate which is then bonded or otherwise attached to the bottom of the shoe. In the first case, a shoe may be manufactured in a conventional manner, and then the particles are bonded to its bottom surface (e.g., by coating with adhesive material and then applying the particles). In the latter case, the substrate typically will be a sheet of material (e.g., a thin sheet of EVA, PVC or TPR) to which the particles are bonded (e.g., by coating with adhesive material and then applying the particles), followed by a process in which the sheet material is bonded to the bottom surface of the shoe (e.g., using adhesive material or heat and/or pressure).

In either of the foregoing embodiments, the type of bonding used (for either attaching the particles or attaching the substrate (if used) to the shoe is not critical, but instead generally will depend in each situation upon external considerations, such as price, desired physical properties, etc. Such bonding may constitute or include, for example, either or both of gluing or application with the use of heat and/or pressure (as to the latter, e.g., inserting the particles into a mold that is used to form the substrate or the bottom of the shoe or inserting the substrate with particles bonded into a mold that is used to form the bottom of the shoe).

In one alternate embodiment, the substrate (to which the particles are, or are to be, bonded or otherwise attached) is bonded to another sheet of material (e.g., EVA, any type of polymer, TPR, or any other natural or synthetic rubber), resulting in a two-layer structure. Then, the combination is cut into shoe sole patterns, with the side of each such shoe-sole pattern then being ground to eliminate visible seams and/or to create any other desired aesthetic effect. Such grinding can be performed either before or after attaching the two-layer structures to the rest of the shoe (or other portions of the shoe).

In the preferred embodiments of the invention, the shoe has a strong and/or durable outsole. One advantage of such a shoe is that it can be used for a time as an indoor shoe and then subsequently used as an outdoor shoe. Such a shoe preferably has a relatively soft fabric bottom (e.g., when flocked with fabric or other fibers), at least across sections of the shoe's bottom surface (e.g., more than 50% of the ground-contacting surface area of the shoe's sole) thereby preventing the surface of indoor floors from becoming scratched, scuffed or otherwise damaged.

Thus, a shoe of the present invention preferably is constructed primarily for outdoor use, but has a bottom that is at least partially covered with small particles, such as natural fibers or other natural materials. There are several well-known distinctions between indoor and outdoor shoes. For example, outdoor shoes typically have significantly more durable bottoms and therefore are capable of being worn outdoors for a long period of time, such as for eight hours a day over a period of one month, two months, four months, eight months or even more than a year, without sustaining wear that would unduly affect the comfort and/or protection provided by the shoe. On the other hand, an indoor shoe generally has a much less durable bottom which would wear out quickly if worn outdoors for any extended period of time.

One commonly used test for determining the durability of a shoe's outsole is ASTM-D1630(NBS) which measures resistance to abrasion and which is promulgated by the American Society for Testing and Materials (ASTM). A shoe according to the present invention preferably has an outsole having a resistance to abrasion, as measured by ASTM-D1630(NBS), of at least 15 percent, 25 percent, 35 percent, 45 percent, 60 percent, 80 percent, 100 percent, 150 percent or 200 percent.

Another distinction between outdoor and indoor shoes is that outdoor shoes typically have outsoles that are much stronger than the outsoles provided on indoor shoes. A strong outsole is highly desirable in an outdoor shoe in order to protect the wearer's foot from injury caused by sharp objects, jagged terrain and similar hazards. Such hazards are a much less significant concern with respect to indoor footwear. One standardized test for determining the strength of an outsole is ASTM-D624 which measures tear resistance. The outsole of a shoe according to the present invention preferably has a tear resistance, as measured by ASTM-D1630(NBS), of at least 4 kilograms(kg)/centimeter(cm), 6 kg/cm, 9 kg/cm 12 kg/cm, 15 kg/cm, 20 kg/cm or 25 kg/cm.

A further distinction between outdoor and indoor shoes is that an outdoor shoe generally must have more cushioning than an indoor shoe, in order to provide adequate comfort when the wearer walks across the variety of different hard and/or rough surfaces that frequently are encountered in connection with outdoor use. Most indoor shoes would not provide a commercially acceptable level of comfort when worn in normal use outdoors.

A still further distinction between indoor and outdoor shoes is that an outdoor shoe typically protects the wearer's foot, much more than an indoor shoe would, from any of a variety of different elements, such as heat, cold and moisture. Thus, for example, an outdoor shoe might be impervious to water, might provide sufficient thermal insulation to keep the wearer's foot warm even worn in temperatures below 32 degrees Fahrenheit (° F.), 20° F. or even 10° F.

A variety of different designs and materials may be utilized in the construction of an outdoor shoe. For example, the shoe's outsole may be made from any of a variety of different materials, including a rubbery material (e.g., cured natural rubber, thermoplastic rubber (TPR), or any other synthetic rubber), natural or a synthetic leather, ethylene vinyl acetate (EVA), a polyurethane elastomer, polyvinyl chloride (PVC), any other plastic materials, and/or any other suitable materials. An outdoor shoe according to the present invention preferably has an outsole that is comprised of at least ¼ inch thick, ⅜ inch thick or ½ inch thick of a plastic material; at least ¼ inch thick, ⅜ inch thick or ½ inch thick of a rubbery material (e.g., natural or synthetic rubber); or at least ⅛ inch thick, 3/16 inch thick or ¼ inch thick of a more rigid or less pliable material, such as natural or synthetic leather. As a further alternative, the shoe's sole may be constructed at least in part from wood and then coated with plastic.

The present invention also contemplates the use of thinner outsoles, e.g., as thin as 1-2 millimeters (mm). For example, outdoor shoes might employ such thin outsoles as the bottom layer of a multi-layer sole. One specific example in this regard is the use of a thin substrate to which the particles are bonded as the bottom layer of the shoe's outsole; see the discussion above.

The following description generally concerns a specific embodiment of the present invention in which natural or synthetic fibers are flocked onto the bottom surface of a shoe. A similar flocking technique may be used to apply a variety of other types of particles, as well. Also, although the following example illustrates certain generally applicable concepts and variations on the present invention, it should be understood that a variety of other types of particles and a variety of other types of techniques for applying them (e.g., using any or all of the following concepts and techniques) may instead be utilized. For example, rather than using a separate adhesive material, the individual particles may be bonded by heating or otherwise temporarily softening the base material and then pressing the particles into the surface of the base material. One example, described in more detail below, uses rollers to manufacture sheet material in this manner.

Flock-Bottomed Shoe.

As indicated above, a shoe according to the present invention preferably has the same appearance as a conventional shoe, except that at least a portion of its bottom surface is coated with flocking material, e.g., natural fibers. Of course, in alternate embodiments of the invention, other small particles attached in any of a variety of other ways, as described in more detail above, may be substituted for such flocking material. Accordingly, references below to flocking or to flocking material generally may also apply to such other small particles and to such other techniques for applying or embedding them. Also, the term "flocking material" simply means material that is suitable for flocking but does not imply that such material can only be applied by flocking, but rather such material may be applied using any of the techniques described herein.

FIG. 1 illustrates a perspective view of a shoe 10 according to a representative embodiment of the present invention. As shown in FIG. 1, shoe 10 includes the conventional features of a shoe, such as an upper portion 12, a sole 14 and a heel 16. It is noted that sole 14 may be comprised of separate components, such as a separate insole (the portion upon which the wearer's foot rests) and a separate outsole (the bottom portion of the shoe 10, other than the heel 16). Alternatively, the insole and outsole of sole 14 may form a single unitary piece, in which case references to either the insole or the outsole refer to that single unitary piece. The upper 12 may be attached to the sole 14 using stitching, gluing, a combination of the two, or any other known technique.

In the illustrated embodiment, the portion 15 of the bottom surface of shoe 10 that normally comes in contact with the ground (i.e., the ground-contacting portion) consists of the entire bottom surface of heel 16 and the portion of the bottom surface of sole 14 that extends approximately from the middle to the front of sole 14. As further shown in FIG. 1, such ground-contacting portion of the bottom surface of shoe 10 is coated with a flocking material 18. At the same time, the portion 19 of the sole 14 that normally does not come in contact with the ground (i.e., the non-ground-contacting portion) is not coated with flocking material 18.

Figure 2:
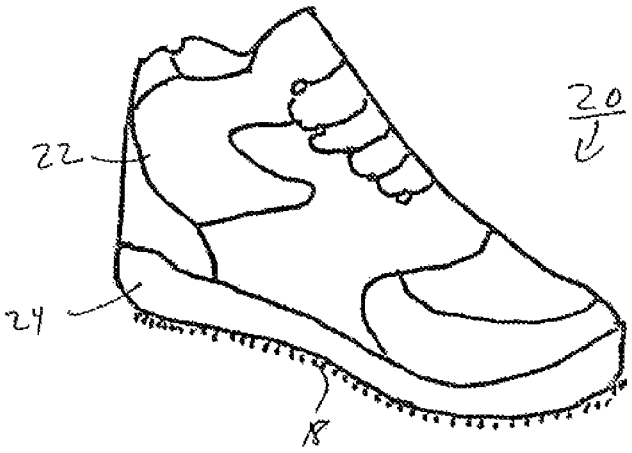
FIG. 2 illustrates a perspective view of a shoe according to an alternative embodiment of the present invention.

FIG. 2 illustrates an alternative embodiment of a shoe 20 according to the present invention. As shown in FIG. 2, shoe 20 also includes an upper portion 22 and a sole 24, but no separate heel. In this embodiment of the invention as well, the ground-contacting portion of the bottom surface of shoe 20 is coated with flocking material 18. In this case, however, because the entire bottom surface of shoe 20 is flat, the entire bottom surface of shoe 20 is covered with such flocking material 18. As described in more detail below, if the bottom surface of shoe 20 has grooves, recesses or other indentations (i.e., is contoured), it is possible to coat only (or primarily) the ground-contacting portion of such bottom surface with flocking material, to coat the entire bottom surface of shoe 20 with flocking material, to coat only (or primarily) the grooves, recesses or other indentations with such flocking material, or any combination thereof.

In still further alternative embodiments of the invention, the entire ground-contacting portion of the bottom surface of a shoe is not coated with flocking material. Rather, only some part of the ground-contacting portion of the shoe's bottom surface is covered with flocking material. In the preferred embodiments of the invention, a substantial part of the ground-contacting portion of the bottom surface of the shoe is covered with natural fabric flocking material. More preferably, at least 50, 60, 70, 80 or 90 percent of the area upon which the shoe normally contacts the ground is fabric material (e.g., individual fibers flocked on).

In one representative embodiment, all of such ground-contacting fabric area has been achieved by flocking. However, it is also possible to use other techniques (e.g., any of the techniques described herein, including molding individual fibers or fabric material into the shoe's outsole, pressing individual fibers or fabric material into the shoe's outsole, or gluing individual fibers or fabric material to the bottom of the shoe) in connection with the flocking to achieve these desired percentages. The specific combination of techniques utilized, as well as the amount and configuration of flocked (or otherwise covered) areas, generally will be dictated by the desired aesthetic effect and/or by functional requirements.

Figure 3A:
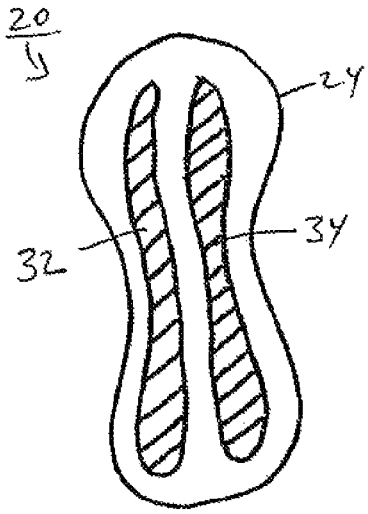
FIGS. 3A and 3B show plan views of the bottom surface of a shoe according to a representative embodiment of the invention.

One example in which only a part of the ground-contacting portion of the shoe's bottom surface is coated with flocking material is illustrated in FIG. 3A, which shows a plan view of the bottom surface of shoe 20. As shown in FIG. 3A, only the left portion 32 and the right portion 34 of the bottom surface of sole 24 are coated with flocking material 18. Where such partial flocking is utilized, it is not critical that any particular areas be coated with flocking material 18. Instead, flocking material 18 may be applied in any desired pattern.

Figure 3B:
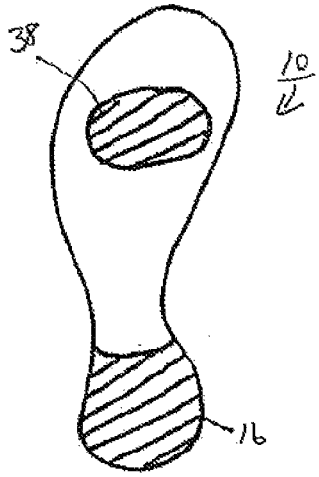

Another example of such partial flocking is shown in FIG. 3B, which illustrates the bottom plan view of shoe 10. In this example, the entire bottom surface of heel 16 is coated with flocking material 18. However, only a portion 38 of the ground-contacting bottom surface of sole 14 is coated with flocking material 18. Once again, the specific arrangement of flocking material in any particular embodiment may be selected to achieve any desired aesthetic effect and/or any functional objectives, such as comfort and/or slip resistance.

Any conventional flocking technique may be utilized to achieve the flocking material patterns discussed above. Generally speaking, flocking involves coating a desired surface with an adhesive material, placing the article to be flocked into a chamber together with short airborne fabric fibers, and taking steps to cause of the fibers (or other elongated particles) to embed into the surface at a right angle. The most common techniques for achieving this latter result include electrostatically charging the fabric fibers and/or mechanically beating the article to be flocked (typically used when flocking a sheet material). Frequently, a combination of these two techniques is utilized. Specific techniques and materials for applying flocking material to objects are well-known and are described, for example, in U.S. Pat. No. 4,535,121 (Ozelli), U.S. Pat. No. 4,879,969 (Haranoya), U.S. Pat. No. 4,963,422 (Katz), U.S. Pat. No. 5,108,777 (Laird), U.S. Pat. No. 6,106,920 (Pichon), U.S. Pat. No. 6,214,141 (Kim), U.S. Pat. No. 3,776,753 (Habib), and U.S. Pat. No. 4,640,858 (Barnett); each of which is incorporated by reference herein as though set forth herein in full.

In the preferred embodiments of the invention, the flocking material is applied directly to the base material, i.e., the material that otherwise would form the bottom surface of the heel and/or to the material that otherwise would form the bottom surface of the outsole of the subject shoe. Preferably, this is done before the upper of the shoe is attached to the heel and/or outsole. However, it is also possible to apply the flocking material to the bottom of the shoe after the shoe has been fully constructed. Still further, the flocking material may be applied at any other point during construction of the shoe. In any event, where the flocking material is applied directly to the bottom surface of the shoe (i.e., by flocking such bottom surface), the use of electrostatic flocking generally is preferred.

In certain embodiments of the invention, the flocking material first is applied to a fabric backing or other sheet material (e.g., EVA, PVC or TPR). Then, such fabric backing or other sheet material is glued or otherwise bonded onto the bottom surface of the shoe's heel and/or outsole. Alternatively, such a fabric backing or sheet material may be inserted into the mold (e.g., in connection with an injection molding process or a stamping process) when forming the shoe's outsole. In any case, pieces of the flocked fabric or other sheet material may be applied in any desired pattern and, in fact, different types of flocked sheet material (e.g., using different colors of flock fibers, different types of flock fibers, or different types of sheet material) may be applied to different locations on the bottom surface of the shoe.

In certain embodiments, the manufacture of a separate fabric or other sheet material with a flocked surface and then the utilization of such a flocked sheet material in the construction of the shoe's outsole and/or heel may be more cost efficient than flocking the shoe's bottom surface after the outsole, heel, or even the entire shoe, has been fully constructed. In such a case, an entire sheet of material may be flocked and then cut into pieces, each of which being sized and shaped appropriately for a corresponding component of the bottom surface of the shoe. In the preferred embodiments, the backing sheet is fairly thin, e.g., not more than 1, 2 or 5 millimeters (mm) thick.

For example, pieces may be cut in the size and shape of: the entire outsole, a portion of the outsole, the entire bottom surface of the heel, or any combination of the foregoing. When manufacturing flocked sheet material for use in the construction of a shoe, the flocked material may be applied prior to or after any appropriate shaping of the surface of the material (e.g., the creation of any desired grooves, recesses or other indentations, in any desired pattern). If applied afterward, then the flocking material may be applied only (or primarily) to the lowest extending portions of the material's surface or to the entire surface of such sheet material, only (or primarily) to the indentations in the material's surface, in any other differential manner between the protrusions and indentations, or to the entire surface of such sheet material, e.g., by selectively applying the adhesive material in the manner described below. In addition, after such flocking, and either before or after incorporation of such flocked sheet material into the corresponding shoe, some or all of the flocked material may be ground off in any desired pattern.

With regard to the partial flocking mentioned above, many shoes have contoured or three-dimensional patterns on their bottom surfaces. With regard to such shoes, the adhesive may be applied (e.g., by spraying, brushing, rolling or dipping) such that the entire contoured surface is coated. Alternatively, the adhesive may be applied (e.g., by brushing, rolling or dipping) such that only to the lowest extending portions of the surface (i.e., those portions that normally would come into contact with the ground) are coated. Still further, the adhesive may be applied to the indentations or to any other selected portions, e.g., by applying it by hand or by using a spray template.

Figure 4:
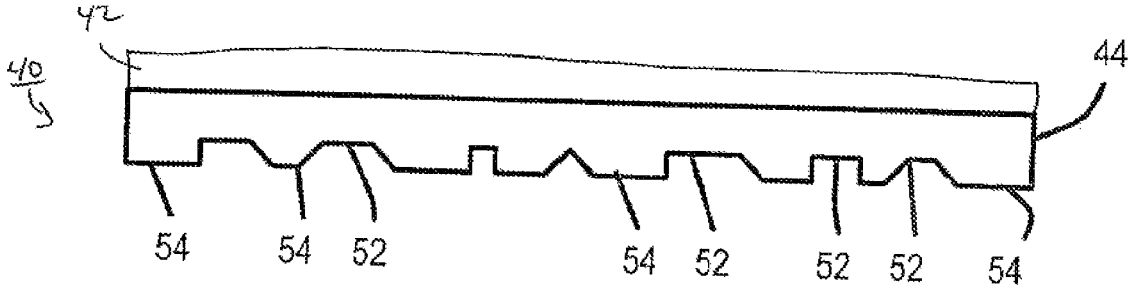
FIG. 4 illustrates a portion of a cross-section of a shoe outsole in accordance with a representative embodiment of the invention.

An advantage of this latter technique is illustrated in FIG. 4, which shows a portion of a cross-section of a shoe sole 40 that includes an insole 42 and an outsole 44. As shown in FIG. 4, the bottom portion of outsole 44 includes multiple indentations (or indented surface area) 52. Typically, such indentations 52 will be closely spaced and/or a very narrow, with multiple (e.g., 2, 5, 10 or more) such indentations 52 occurring when traversing the bottom of the shoe sole 40 from side to side and/or from front to back. Often, the indentations 52 will be approximately 1-2 millimeters (mm) in width and/or separated from each other by no more than approximately 1-2 mm of lower-extending portions 54. However, any desired widths and/or spacings may be used.

By brushing or rolling adhesive onto only the lowest extending parts 54 of the bottom portion of outsole 44, and avoiding applying the adhesive into such indentations 52, it generally will be easier to ensure that flocking material only (or primarily) will adhere to such lowest extending parts 54. Similarly, by dipping the outsole 44 into a thin layer of adhesive, generally only (or primarily) such lowest extending parts 54 will be coated with adhesive and, therefore, ultimately coated with flocking material 18.

It is noted that brushing, rolling or dipping allows one to only coat the lowest extending portions 54 with adhesive, with the result that some or all of the lowest extending portions 54 ultimately are covered with the small particles, while some or all of the indentations are substantially uncoated with such small particles. Another technique for accomplishing the same result is to place against the bottom of the shoe, prior to applying the adhesive, a template which is the three-dimensional reverse of the pattern on the bottom of the shoe. In this way, the template fills in the indentations 52, preventing them from being coated with adhesive during the adhesive-application process. Once the adhesive has been applied, the template can be removed and, in certain embodiments, reused for another shoe.

On the other hand, by applying adhesive both to the lowest extending parts 54 and to the indentations 52 (e.g., by spraying, dipping, rolling or brushing), the entire bottom surface of the subject portion of outsole 44 generally will be coated with flocking material 18. Then, when ultimately used outdoors only the flocking material on the lowest extending parts 54 generally will tend to wear away. In certain embodiments, it may be visually undesirable to then have only the indentations 52 coated with flocking material 18. In other embodiments, however, depending upon the particular ornamental design of the bottom surface of the shoe, such partial wearing away of the flocking material 18 might actually result in a pleasing aesthetic effect. Moreover, the same shoe might have areas of the bottom surface coated with flocking material only on the lowest extending portions 54 and other areas where both the lowest extending portions 54 and the indentations 52 are coated with flocking material, in order to achieve a desired combination of these two different aesthetic effects.

Once the flocking material (or other small particles) have been applied, it may be desirable to grind the fibers or other particles to a desired depth.

Sheet Material with Embedded Fibers or Fabric Material

In one aspect, the present invention pertains to a composite sheet material that has a plurality of individual fibers or a piece of fabric material embedded within a non-fibrous material, and also pertains to techniques for manufacturing such a composite sheet material.

In this regard, it often is desirable to manufacture a shoe sole having a composite surface, including some areas in which one type of material contacts the ground and other areas in which another type of material contacts the ground. For example, the first type might be a synthetic rubber or other polymer that ordinarily is used as a material for forming a shoe's outsole, while the second type might be a plurality of natural or synthetic fibers or a piece of natural or synthetic fabric. In this disclosure, the term "fabric material" is used in its ordinary sense of referring to a woven or non-woven material that resembles cloth, with its individual fibers bound together, while the term "fibers" refers to distinct particles or strands that generally are not bound together unless otherwise indicated as being so. The techniques of the present invention can be applied with respect to either individual fibers or fabric material. Such individual fibers and fabric material collectively are referred to herein as "fibrous material". In the preferred embodiments, the fibrous material is a natural material, e.g., a natural fabric-type fibrous material.

Specifically, the present invention contemplates two general categories of techniques for manufacturing such a composite material. In the first, both a non-fibrous material and a fibrous material are fed together through an extrusion device (e.g., a conventional extrusion device) that ordinarily is used for manufacturing sheets of non-fibrous material. Such non-fibrous materials can include, e.g., polyvinyl chloride (PVC), acrylonitrile butadiene styrene (ABS), thermoplastic rubber (TPR), ethylene vinyl acetate (EVA), a polyurethane elastomer, natural or synthetic rubber, synthetic leather, any polymer or any type of plastic. It is noted that a conventional extrusion device implements a shaping process in which a continuous sheet of material is produced, typically by forcing liquid or semi-liquid material underneath one or more rollers or between one or more pairs of rollers. As the material exits, it typically is carried along a conveyor, cooled or otherwise allowed or forced to harden, and then cut to the desired length.

According to the first category of embodiments of the present invention, if a fabric material is being used to produce the composite sheet material, the fabric material may be fed underneath the roller(s) together with the liquid or semi-liquid non-fibrous material, so that the resulting material has the desired composite composition. Typically in such a case, the fabric material will be inserted underneath the liquid or semi-liquid non-fibrous material. Alternatively, the sheet of fabric material may be pressed onto the non-fibrous material after the non-fibrous material has exited the roller(s) and is still in a liquid or semi-liquid state. In any event, once the non-fibrous material hardens, the desired composite sheet of material will result.

On the other hand, where individual fibers are being embedded into the non-fibrous material, such fibers may be pre-mixed together with the liquid or semi-liquid material. Alternatively, if, for example, only one side of the resulting composite sheet material is desired to have the composite surface, and/or one wishes to be sure that the individual fibers form a significant part of the surface area for the resulting composite sheet, the individual fibers may be sprinkled or sprayed, during the shaping process or afterward (e.g., on the conveyor belt before the non-fibrous material has hardened or has fully hardened). For example, in one representative embodiment where two or more consecutive rollers are being used, the fibers are sprinkled or sprayed between the rollers.

The second general class of embodiments contemplated by the present invention involves the impression of the plurality of individual fibers or the sheet of fabric material into the surface of the pre-manufactured sheet of non-fibrous material. Typically, a roll of such pre-manufactured non-fibrous material (e.g., any of the types of material mentioned above) is first obtained. Then, a sheet of fabric material is placed on one side of the non-fibrous material, and the combination is passed underneath heated rollers, which apply heat and pressure, partially melting the surface of the non-fibrous material and causing the fabric material to embed into it. A similar technique can be applied by coating the non-fibrous sheet of material with individual fibers and then passing the combination underneath heated rollers. Still further, depending upon the type of the non-fibrous sheet material, chemical or radiation techniques may be utilized to temporarily soften the surface of the non-fibrous material so that the sheet of fabric material or individual fibers can be embedded into it, or even pressure alone can be used to embed the fibrous material into the non-fibrous material.

Generally speaking, in the foregoing embodiments only a single side of the non-fibrous material is embedded with fibrous material. However, in alternate embodiments both sides of the non-fibrous material are embedded with fibrous material, which may be the same fibrous material on both sides or different fibrous materials may be used for the two different sides.

In any event, once a sheet of composite material has been manufactured in accordance with any of the foregoing techniques, it can be cut into any desired shapes and used for any desired purpose. As noted above, one such purpose is to fabricate the outsole of a shoe. The selection of the fibrous and non-fibrous materials for use in the methods of the present invention preferably depends upon the desired characteristics of the resulting composite material.

Outsole or Sheet Material with Particles Bonded to Indentations.

In the following embodiments of the invention, portions of the bottom of a shoe or the surface of a sheet material are covered with a plurality of small particles. Preferably, the particles are fibers and, more preferably, natural fibers that cover only a portion of the bottom surface of the shoe or sheet material. Initially, the following discussion concerns the bottom surface of a shoe and then the same concepts are extended with respect to a general-purpose sheet material.

In the preferred embodiments of the invention, individual fibers are flocked onto the bottom of the shoe (i.e., using techniques that tend to cause them to embed at a substantially right angle to the surface). However, other gluing or bonding techniques instead may be used, or in certain cases the fibers or other small particles (either individually or after being flocked or otherwise bonded onto a sheet of backing material) may even be molded or pressed into the bottom surface of the shoe.

Figure 5:
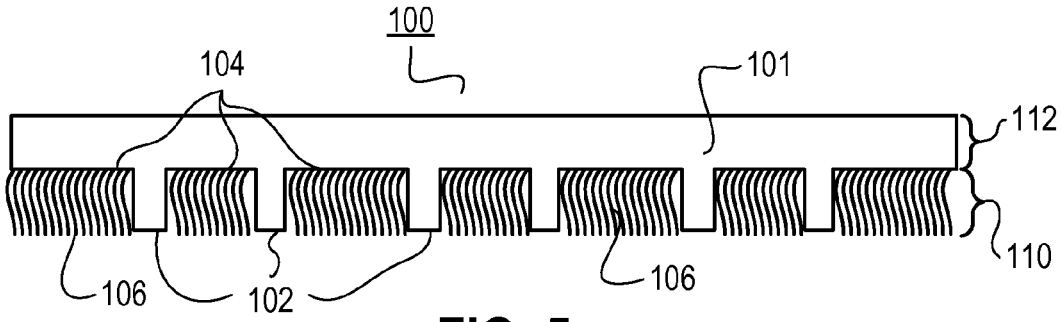
FIG. 5 illustrates a cross-sectional view of a shoe's outsole or of a piece of sheet material, according to representative embodiment of the present invention, in which the fibers are bonded to indentations in the base material at a substantially right angle.

FIG. 5 depicts a cross-sectional view of a shoe's outsole 100. The term "outsole" as used herein refers to the bottom portion or layer of a shoe (i.e., the portion that is adjacent to the ground in normal use). Accordingly, the term outsole may encompass, e.g., the bottom portion of a shoe's heel, where a separate (e.g., an elevated) heel is used. As shown in FIG. 5, the base material 101 of the shoe's outsole has an arrangement of alternating areas in which lower-extending portions 102 (which actually contact the ground in normal use) alternate with indentations 104, which ordinarily would not contact the ground in normal use, but which are covered with natural fibers (or other small particles) 106 that do contact the ground.

In the present embodiment, fibers 106 have been flocked onto the appropriate sections of the bottom of outsole 100. As shown, the flocked fibers 106 extend from the indentations 104 down to approximately the same level as the lower-extending portions 102, so that both the fibers 106 and the lower-extending portions 102 ordinarily will contact the ground in normal use. Because the fibers 106 generally will be softer and more compressible, in certain embodiments of the invention they actually can extend below the surfaces of the lower-extending portions 102 (in their uncompressed state), e.g., slightly below such surfaces, so that when weight is applied they are compressed down to the same level as the surfaces of the lower-extending portions 102.

Figure 6:
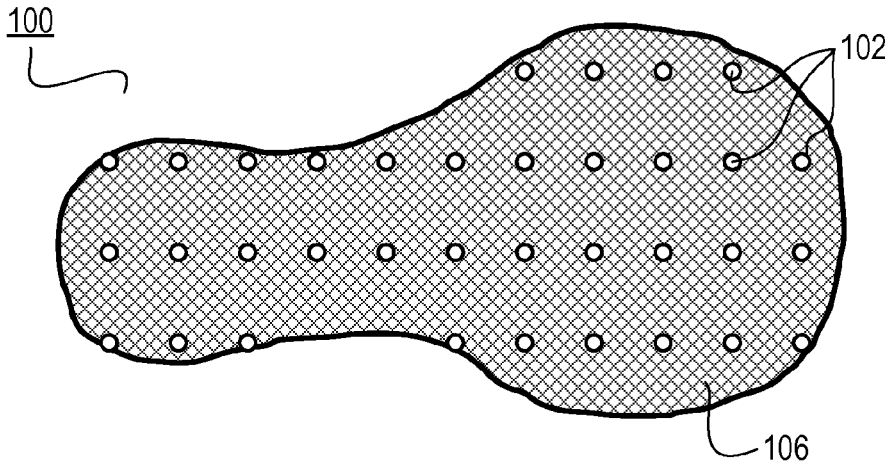
FIG. 6 illustrates a pattern covering the bottom of the shoe's outsole in which lower-extending portions alternate with bonded particles, according to a first representative embodiment of the invention.
Figure 7:
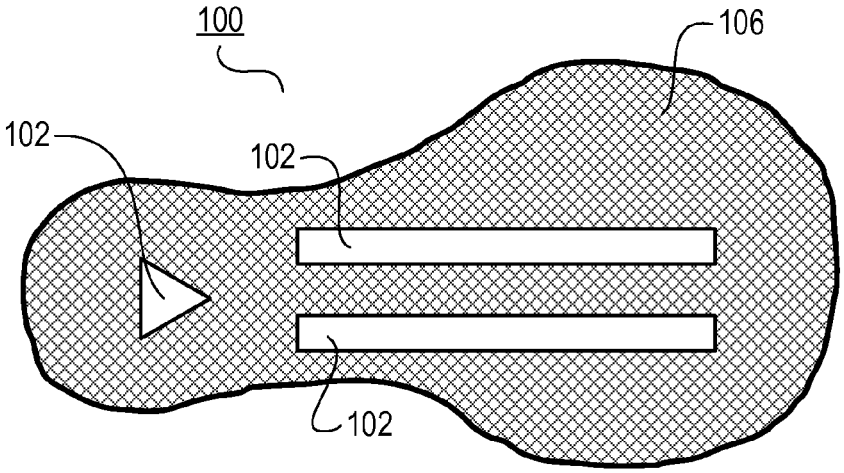
FIG. 7 illustrates a pattern covering the bottom of the shoe's outsole in which lower-extending portions alternate with bonded particles, according to a second representative embodiment of the invention.

FIGS. 6 and 7 illustrate different patterns in which the lower-extending portions 102 alternate with the natural fibers 106. In both patterns, all of the lower-extending portions 102 of the base material 101 for outsole 100 are uncoated and all of the indentations 104 are coated with the natural fibers 106, e.g., such fibers 106 having been flocked on. In alternate embodiments only some of the lower-extending portions 102 are covered with the fibers or other small particles 106 and/or some or all of the indentations 104 may be coated with some of the small particles 106. However, in the preferred embodiments at least some of the protrusions 102 are substantially uncoated with such fibers or other small particles 106. That is, the present invention contemplates a differential coating in which the indentations 104 are coated with the small particles 106 to a greater extent than the protrusions 102.

In FIG. 6, the base material 101 is formed so as to have a repeating pattern in which the lower-extending portions 102 are arranged in a regular grid. In FIG. 7, the lower-extending portions 102 are arranged in a more decorative design, with fewer such lower-extending portions 102, but with each such portion 102 being larger than those of FIG. 6.

In alternate embodiments, any combination of regular patterns and/or more decorative designs may be used, and any sizes and/or combinations of sizes may be used in order to achieve any desired functional and/or aesthetic purpose. However, in the preferred embodiments, the areas of the bottom of the shoe covered by the fibers (or other particles) 106 constitute 50% or more of the surface area of the shoe's outsole 100 that contacts the ground in normal use. More preferably, the areas covered by the fibers (or other particles) 106 constitute at least 50-90% of the surface area of the shoe's outsole 100 that contacts the ground in normal use.

The foregoing patterns can be achieved by manufacturing the base material 101 so as to have the desired protrusions 102 and indentations 104, e.g., from any natural or synthetic material (e.g., EVA, PVC or synthetic rubber). In the preferred embodiments, base material 101 is injection-molded or otherwise molded in sheet form and then cut to the desired size and shape, as described in more detail below. It is noted that the regular repeating pattern of FIG. 6 typically will be easier to manufacture, and often can be produced simply using an extrusion process, as described above.

In any event, adhesive is applied only (or primarily, e.g., as a result of manufacturing errors or to achieve a desired aesthetic effect) to the indentations 104 (e.g., by using a pattern of glue touch-points that matches the pattern of indentations 104, by using a spray template, or by manually applying glue only or primarily to the indentations 104). The end result is that the indentations 104 (or at least selected ones of such indentations 104) predominantly will be coated with the flocking or other particles 106, while the protrusions 102 predominantly will be uncoated with such flocking or other particles 106. Next, the fibers 106 are applied, e.g., by flocking or simply blowing the fibers 106. Finally, any fibers 106 that attached to the lower-extending portions 102 preferably are ground off. Alternatively, the entire bottom of the shoe, protrusions 102 and indentations 104, can be flocked or otherwise coated with fibers 106, and then the fibers 106 can be ground off from the lower-extending portions 102.

In the preferred embodiments, the protrusions 102 extend only slightly below the indentations 104, e.g., so that the depth 110 of the indentations 104 to be coated with the fibers 106 is less than 5 millimeters (mm), or even as shallow as 0.1 mm, but, more preferably, is approximately 1-2 mm. As a result, fibers 106 of approximately that length can be used to achieve the desired effect. Similarly, the thickness 112 of the base material 101, disregarding the protrusions 102, preferably also is less than 5 mm, again even as thin as 0.1 mm, but, more preferably, is approximately 1-2 mm.

One advantage of the foregoing configuration is that, because different types of materials contact the ground simultaneously, the resulting shoe can be manufactured so as to have good traction on a variety of different surfaces. In such a case, for example, the base material 101 might be optimized for one type of surface while the fibers 106 are optimized for another.

Another advantage, particularly with respect to embodiments in which the fibers 106 in their uncompressed state extend beyond the surface of the lower-extending portions 102, is that the fibers 106 can be selected so as to provide a unique two-stage cushioning effect. In such embodiments, a relatively soft cushioning effect is achieved as the fibers 106 contact the ground first and then are crushed and compressed. Eventually, when the fibers 106 have been sufficiently compressed, the base material 101 also contacts the ground and therefore begins to absorb the force, typically providing a firmer cushioning effect.

Figure 8:
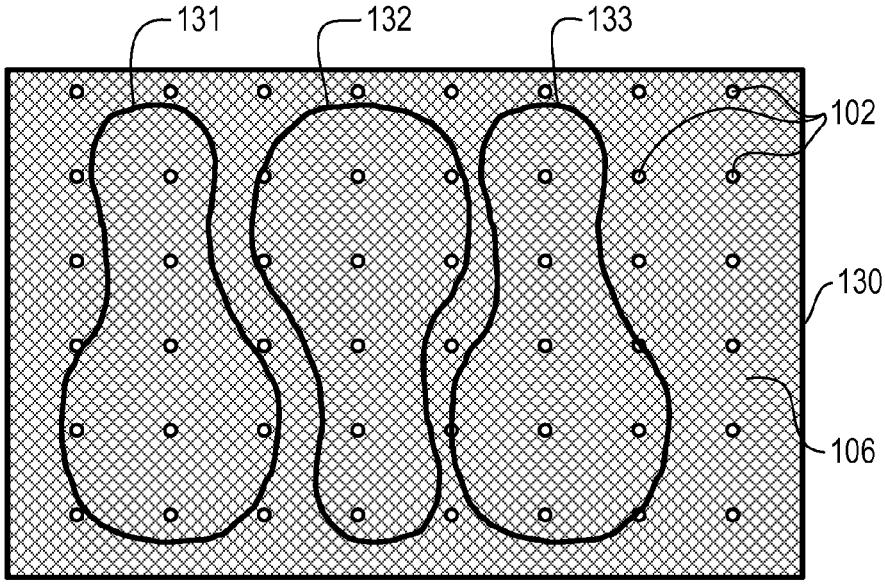
FIG. 8 illustrates one example of a portion of a sheet material, having the same surface pattern as that shown in FIG. 6, according to a representative embodiment of the present invention.

It is noted that the foregoing construction can be applied to sheets of material 101 that may then be cut into any desired shapes, sizes and/or patterns, and then used for any of a variety of different purposes. FIG. 8 illustrates one example of a portion of a sheet material 130 having a pattern that is similar to the pattern shown in FIG. 6, i.e., with a regular grid of lower-extending portions 102 and with the indentations between such lower-extending portions 102 having been flocked (or otherwise coated) with natural fibers 106. The cross-section of sheet material 130 might be, e.g., similar or identical to the cross-section shown in FIG. 5, e.g., with the same preferred dimensions. In the preferred embodiments, the sheet material 130 is manufactured on a continuous basis, rolled and then cut when a roll of the desired size is finished.

Thereafter, such material may be used in manufacturing a wide variety of products. As mentioned above, one use of such material is for the outsole of a shoe. Thus, for example, each of patterns 131-133 may be cut out of the sheet material 130 and then glued or otherwise attached to another component of the shoe in order to form all or portions of the bottom surface of a completed shoe.

Figure 9:
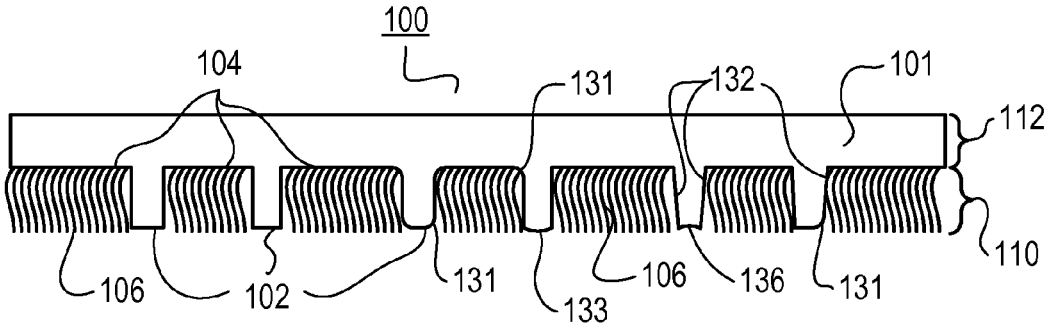
FIG. 9 illustrates a cross-sectional view of a shoe's outsole or of a sheet material according to an alternate representative embodiment of the present invention, in which the protrusions and indentations have varying contours.

A number of variations on the foregoing embodiments are possible. For example, although the protrusions 102 and the indentations 104 are shown in FIG. 5 as having flat surfaces and right-angle edges, any other shapes or designs may be used. Either or both of the protrusions 102 and indentations 104 may be rounded, have triangular, trapezoidal or pyramid shapes (e.g., so that the protrusions 102 resemble pinnacles), or have any other two-dimensional or a three-dimensional shape. An example is illustrated in FIG. 9, in which the various protrusions 102 and indentations 104 include rounded corners 131, sloping edges 132, convex surfaces 133 and concave surfaces 136. Generally speaking, however, flat or nearly flat surfaces and the use of flocking will help to ensure that the heights of the fibers 106 are approximately the same as the heights of the protrusions 102.

Figure 10:
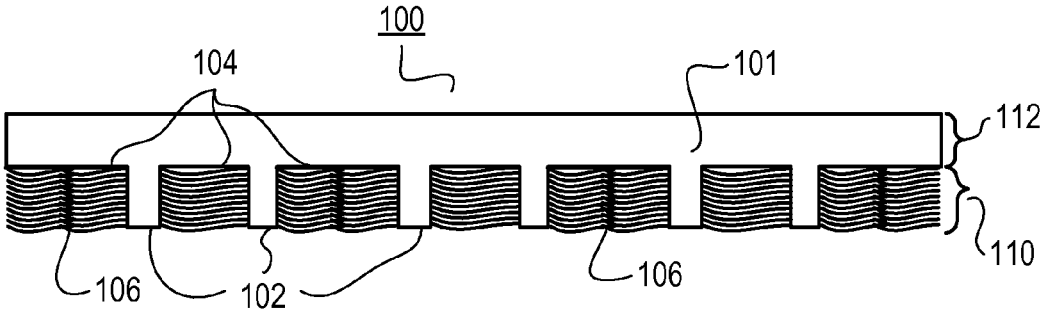
FIG. 10 illustrates a cross-sectional view of a shoe's outsole or of a piece of sheet material according to an alternate representative embodiment of the present invention in which the fibers are bonded in a substantially parallel manner to indentations in the base material.

Also, although the fibers 106 generally are shown in the drawings and described above as having been flocked on (i.e., so they tend to embed at a right angle), such fibers instead may be attached to the base material 101 so that they are approximately parallel to the plane formed by the base material (e.g., in a matted-down or flattened configuration). Such a configuration is illustrated in FIG. 10. In such a case, the fibers 106 may be attached by allowing adhesive material to seep through the fibers 106, or by using any combination of adhesive material, heating and rolling to bind such fibers 106 to the base material 101.

Completing Construction of the Entire Shoe

The foregoing discussion focuses on the construction of a shoe's outsole, e.g., the bottom layer of the shoe which is adjacent to the ground in normal use. Once an outsole according to the present invention has been constructed it can be joined in any known manner to the other components of a shoe in order to complete construction of the shoe. For example, the outsole maybe glued or bonded to a midsole or may be molded together with other portions of the shoe's sole. Alternatively, the base material for the outsole may be already attached to other components for the shoe or to the entire rest of the shoe before particles are attached to such base material, as described herein. The specific technique for completing construction of the entire shoe typically will depend upon the type of the shoe which is being manufactured, and the present invention applies to a wide variety of open shoes (e.g., sandals and thongs) and closed shoes (e.g., boots, athletic shoes, dress shoes and casual shoes).

Additional Considerations.

Several different embodiments of the present invention are described above, with each such embodiment described as including certain features. However, it is intended that the features described in connection with the discussion of any single embodiment are not limited to that embodiment but may be included and/or arranged in various combinations in any of the other embodiments as well, as will be understood by those skilled in the art.

Similarly, in the discussion above, functionality sometimes is ascribed to a particular module or component. However, functionality generally may be redistributed as desired among any different modules or components, in some cases completely obviating the need for a particular component or module and/or requiring the addition of new components or modules. The precise distribution of functionality preferably is made according to known engineering tradeoffs, with reference to the specific embodiment of the invention, as will be understood by those skilled in the art.

Thus, although the present invention has been described in detail with regard to the exemplary embodiments thereof and accompanying drawings, it should be apparent to those skilled in the art that various adaptations and modifications of the present invention may be accomplished without departing from the spirit and the scope of the invention. Accordingly, the invention is not limited to the precise embodiments shown in the drawings and described above. Rather, it is intended that all such variations not departing from the spirit of the invention be considered as within the scope thereof as limited solely by the claims appended hereto.

What is claimed is:

1. A shoe, comprising:

an outsole having a bottom surface; and an upper extending above the outsole, wherein the outsole is comprised of:

(a) a base material that includes a plurality of indentations and lower-extending portions and (b) a plurality of individual natural fibers, wherein the individual natural fibers are bonded into at least some of the indentations, but wherein the lower-extending portions predominantly are uncoated with said individual natural fibers, and wherein areas of the individual natural fibers and the lower-extending portions form at least a portion of the bottom surface of the outsole.

2. A shoe according to claim 1, wherein the individual natural fibers have been flocked onto the base material.

3. A shoe according to claim 1, wherein the individual natural fibers extend down to approximately a same level as the lower-extending portions.

4. A shoe according to claim 1, wherein the individual natural fibers have an uncompressed state in which at least some of said individual natural fibers extend down below a surface of the lower-extending portions.

5. A shoe according to claim 1, wherein the individual natural fibers are bonded into substantially all of the indentations.

6. A shoe according to claim 1, wherein the individual natural fibers cover at least 50% of that portion of the outsole that contacts the ground in normal use.

7. A shoe according to claim 1, wherein the individual natural fibers have been attached using separately applied adhesive material.

8. A shoe according to claim 1, wherein the individual natural fibers extend to a depth that is not greater than 2 millimeters.

9. A method of manufacturing a shoe, comprising:

(a) obtaining a sheet of base material having a surface that includes a plurality of indentations and lower-extending portions;

(b) cutting at least a portion of an outsole for a shoe from the sheet of base material; and (c) attaching the at least a portion of the outsole to another component of the shoe, wherein individual natural fibers are bonded into at least some of the indentations in the base material, but the lower-extending portions predominantly are uncoated with said individual natural fibers, and wherein the individual natural fibers and the lower-extending portions form a bottom surface of the at least a portion of the outsole.

10. A method according to claim 9, wherein the individual natural fibers have been flocked onto the base material.

11. A method according to claim 9, wherein the individual natural fibers extend down to approximately a same level as the lower-extending portions.

12. A method according to claim 9, wherein the individual natural fibers have an uncompressed state in which at least some of said individual natural fibers extend down below a surface of the lower-extending portions.

13. A method according to claim 9, wherein the individual natural fibers are bonded into substantially all of the indentations.

14. A method according to claim 9, wherein the individual natural fibers cover at least 50% of the bottom surface of the at least a portion of the outsole.

15. A method according to claim 9, wherein the individual natural fibers have been attached using separately applied adhesive material.

16. A method according to claim 9, wherein the individual natural fibers extend to a depth that is not greater than 2 millimeters.

17. A shoe according to claim 1, wherein the individual natural fibers are soft fibers, bonded at one end into the indentations, and then extending toward the bottom surface of the outsole unattached along the majority of their entire lengths.

18. A method according to claim 9, wherein the individual natural fibers are soft fibers, bonded at one end into the indentations, and then extending toward the bottom surface of the outsole unattached along the majority of their entire lengths.

* * * * *

UNITED STATES PATENT AND TRADEMARK OFFICE

CERTIFICATE OF CORRECTION

PATENT NO. : 8,661,713 B2
APPLICATION NO. : 11/530419
DATED : March 4, 2014
INVENTOR(S) : Koo et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1950 days.

Signed and Sealed this
Sixteenth Day of June, 2015

Michelle K. Lee

Michelle K. Lee
*Director of the United States Patent and Trademark Office*